US005098260A

United States Patent [19]

Smith et al.

[11] Patent Number: 5,098,260

[45] Date of Patent: Mar. 24, 1992

[54] POSITION-SERVO DEVICE FOR POSITIONING A STOP IN A POSITIVE DISPLACEMENT FUEL INJECTION SYSTEM

[75] Inventors: Edward D. Smith, Decatur County; Lester L. Peters, Columbus, both of Ind.

[73] Assignee: Cummins-Engine Company, Inc., Columbus, Ind.

[21] Appl. No.: 512,442

[22] Filed: Apr. 23, 1990

[51] Int. Cl.[5] ..... F04B 17/00

[52] U.S. Cl. ..... 417/339; 417/390; 92/13.1; 92/13.6; 91/398; 91/382

[58] Field of Search ..... 417/339, 390, 392, 404; 123/500, 501, 502, 446, 447; 137/625.22; 92/13.1 P, 13.6 X, 13; 91/375 R, 380, 398 X, 382 X

[56] References Cited

U.S. PATENT DOCUMENTS 2,502,989 4/1950 Rathbun ..... 123/446
4,092,964 6/1978 Hofer et al. .
4,381,750 5/1983 Funada ..... 123/446
4,406,263 9/1963 Leblanc et al. .
4,407,250 10/1983 Eheim et al. .
4,478,188 10/1984 Eheim .
4,501,246 2/1985 Leblanc .
4,505,244 3/1985 Smith .
4,621,605 11/1986 Carey, Jr. et al. .
4,696,271 9/1987 LeBlanc .

*Primary Examiner*—Richard A. Bertsch
*Assistant Examiner*—Charles Freay
*Attorney, Agent, or Firm*—Sixbey, Friedman, Leedom & Ferguson

[57] ABSTRACT

An electro-hydraulic position-servo device to quickly and accurately position a stop element is provided for use with a positive displacement fuel injection system, wherein a shuttle is used to positively displace pre-metered slugs of fuel to unit injectors. The stop device is operatively associated with a control shaft having at least one helical surface thereon; the stop element and control shaft slidably located within a housing. The housing permits communication between at least one pressurized fluid source and a drain line by way of a chamber within which the control shaft is located. Thus, by simply rotating the control shaft from rotational drive means, the control shaft will assume an axial position determined by the orientation of the helical surface with respect to the supply and drain lines. The device is adjustable by rotation of the shaft to a new position with the re-orientation of the helical surface.

17 Claims, 3 Drawing Sheets

POSITION-SERVO DEVICE FOR POSITIONING A STOP IN A POSITIVE DISPLACEMENT FUEL INJECTION SYSTEM

TECHNICAL FIELD

The present invention relates generally to a position-servo device for locating a stop element utilizing fluid pressure and a helical surface on a control shaft. The helical surface is not actually a true helix but is a surface formed along a plane that is oblique to the control shaft axis. Hereinafter, the term "helical" is used to refer to such an obliquely arranged surface. Particularly, the present invention is related to a positive displacement type fuel injection system that has a piston or shuttle used for displacing a metered quantity of fuel to the injectors.

BACKGROUND ART

Fuel injection systems including fuel pumps with a positive displacement piston and rotary distributor valves are known in the art. One example of such a fuel injection system is shown in U.S. Pat. No. 4,621,605 to Carey, Jr. et al. and assigned to Dummins Engine Company, Inc., the assigneee of the present invention. Basically, the disclosed fuel injection system includes a fuel pump having two piston assemblies, one of which forms and delivers pre-metered slugs of fuel to unit injectors, and the other of which delivers pre-metered slugs of timing fluid to the unit injectors. Such a system is more complex than a basic single piston pump delivering only injection fuel to the unit injectors; however, the inclusion of a timing pump simply requires the use of two similar pistons and control mechanisms.

To control the piston movement in the system disclosed in the above identified Cary, Jr. et al. patent, a means is provided to stop the piston travel at one end of its stroke in an adjustable manner so that the amount of fuel metered for either injection fuel or timing fuel can be accurately and precisely controlled. Specifically, the length of the stroke of each of the pistons is set by an adjustment control means that varies the volume of fuel and timing fluid slugs on a cycle by cycle basis during operation of the internal combustion engine within which such a fuel pump is associated. Disclosed generally in the Carey, Jr. et al. patent is a movable stop arm for each piston attached to a suitable control mechanism. No specific control mechanism is disclosed; however, the patent teaches that the control mechanism associated with each adjustment control means can be mechanical, electrical, hydraulic, or the like, and can be adjusted on a cycle by cycle basis to control the pre-metered volume of the fuel and timing fluid slugs formed and delivered by the fuel system. Moreover, the injection fuel movable arm can be adjusted and controlled independently of the timing fluid stop arm.

Hydraulic control shafts and mechanisms used in conjunction with a positioning device are also known in the art. Particularly, such devices operate to control fluid flow, and have been designed with helical control surfaces provided on a control shaft which are associated with various supply and drain passages. However, prior art devices of this type utilize the helical control surfaces as a means for controlling the connection and amount of fluid flow between passages by both rotational and axial movement of the control shaft, and do not use a helical control surface to provide the axial positioning of the control shaft as determined by the rotation position of the control shaft. An example of such a control shaft with a helical control surface, wherein the shaft is both axially movable and rotationally movable, is shown in U.S. Pat. No. 4,550,702 to Djordjevic. Disclosed is an axially and rotationally movable control shaft including a helical control edge. The fluid chamber associated with the control edge permits communication between a plurality of spill passages, whereby communication between the spill passages is controlled by the axial and rotational position of the control edge. Moreover, the rotational position of the control shaft along with the axial position of the control shaft control the timing and amount of fluid communication between these spill passages. However, and as typical in the prior art, the axial movement of the control shaft is controlled by a fluid chamber having an independent fluid supply acting on a flat end of the control shaft wherein fluid pressure in the chamber urges the control shaft in one direction and in the opposite direction by a mechanically driven pin. The axial position of the control shaft does not depend on the rotational position of the helical control edge.

The basic recognition of the use of rotary positioning of a control shaft in conjunction with axial positioning of the control shaft is also disclosed in U.S. Pat. No. 4,505,244 to Smith, also assigned to Cummins Engine Company. This device includes a helical type control surface which controls fluid flow between a plurality of passages as determined by the rotary position of the control shaft. The control shaft is also a fuel plunger providing metered fuel to a fuel injector. However, as with above identified prior art, the rotary position of the control shaft does not determine the longitudinal or axial position of the control shaft. The rotary position simply determines the timing and amount of fluid flow between fuel passages due to the length of grooves formed on the control shaft body associated with the helical control surface.

In a similar manner, a fuel metering valve is disclosed in U.S. Pat. No. 4,266,571 to Bauder, wherein a helical groove is provided that connects fuel passages and the fluid flow is controlled by rotational positioning of the shaft.

Other U.S. Patents exhibiting an angled or helical control surface on a rotary and axially movable control shaft are known, such as U.S. Pat. No. 4,092,964 to Hofer et al. and U.S. Pat. Nos. 4,406,263, 4,501,246, and 4,696,271 to LeBlanc. These references basically use the rotary position of a control shaft in conjunction with the axial positioning of the control shaft that is provided with angled surfaces for controlling fluid flow between plural passages. None makes use of an angled or helical control surface to axially position such a control rod. Another, U.S. Pat. No. 4,764,092 to Thornthwaite, incorporates the use of rotary position and axial position in a control shaft without an externally provided helical or angled surface, but instead uses an internal passage with inlet and outlet ports axially displaced. Basically, such an internal passage functions similarly to the external angled surface disclosed in the above-noted prior art.

Further with respect to fuel injection systems utilizing a piston or shuttle type system including an adjustable stop, the U.S. Pat. Nos. 4,478,188 and 4,407,250, to Eheim and Eheim et al., are noted. Disclosed in these patents are combinations of hydraulic, mechanical and electrical means for positioning stop elements to control metering of fuel from a fuel supply piston. However, there is no disclosure of positioning the stop member in a hydraulic manner that specifically makes use of an angled or helical control surface.

In short, the prior art has failed to show a simple and highly accurate means to control a stop position based o the hydraulic positioning of the stop member that is suitable for use in a fuel injection system.

SUMMARY OF THE INVENTION

Thus, it is an object of the present invention to provide a stop positioning device that is easily incorporated into a fuel injection system which requires a minimum of parts and is precisely and quickly positionable.

It is a further object to provide an electrohydraulic position-servo device, wherein rotary position of a control shaft determines the axial position of the control shaft and a stop associated therewith. Rotary motion is provided by electric means and axial positioning is responsive to hydraulic means.

It is another object to provide the control shaft with a helical control surface so that when the control shaft is rotationally moved, the resultant hydraulic reaction determined by the position of the helical control surface will determine the axial position of the control shaft. Such a system is advantageously quick and simple with a minimum of moving parts, and can be adjusted in response to engine operating characteristics on a cycle-by-cycle basis.

It is yet another object to provide such a position-servo for locating a stop element in a positive displacement fuel injection system utilizing pistons or shuttles for supplying pre-metered slugs of fuel to fuel injectors.

It is a still further object to provide the position-servo device with pressurized fuel as the hydraulic fluid utilized to axially position the control shaft from a same pressurized fuel source used for the metered fuel slugs.

In order to achieve these objects, an electrohydraulic position-servo device is provided. In one embodiment, an axially and rotationally movable control shaft is provided within a chamber of a housing, the control shaft having an oblique non-ending circumferential groove defining two helical control surfaces, wherein the circumferential groove is connected by a passage through the control shaft to a pressure chamber provided between the housing and an end surface of the control shaft. The housing is also provided with a pressure passage and a drain passage which are selectively blocked or opened by rotation of the control shaft, wherein the rotary position determines the axial position of the control shaft because of the location of the helical control surfaces with respect to both the pressure and drain passages. The control shaft is rotationally driven by a low torque stepping motor, but is axially movable thereto, and a shuttle stop element is provided in engagement with the other end of the control shaft so as to be moved thereby. Fluid pressure is used from the same pressurized fuel source as is used in the fuel metering process, so it is necessary that the end surface of the control shaft associated with the pressure chamber have a larger surface area than a surface area of an end of the shuttle stop subject to fuel pressure in the metering process. Since the stepping motor only has to overcome frictional forces in rotating the control shaft, only a low torque motor is required.

In another embodiment, a control shaft is similarly rotationally driven by a low torque stepping motor and is slidably movable in an axial direction within a housing. In this embodiment, a single helical control surface is provided on the control shaft, wherein a pressure chamber is formed between the helical control surface and the internal walls of the housing. As a result, the pressurized fuel supplied to the pressure chamber will drain through a drain passage in dependence on the rotational position of the control shaft which determines when the drain passage is opened. In yet another embodiment, a control shaft is provided with a helical non-ending raised portion. In this case, a drain slot is provided of a like width as the axial length of the helical portion, and pressurized fuel is supplied to pressure chambers on both sides of the helical portion. Thus, rotary location of the control shaft determines the equilibrium position of the control shaft in an axial sense for positioning a stop element.

These and other objects, features, and advantages of the present invention will become more apparent from the following description when taken in conjunction with the accompanying drawings which show, for purposes of illustration only, plural embodiments in accordance with the present invention.

DETAILED DESCRIPTION OF THE PREFERRED EMBODIMENTS

Figure 1:
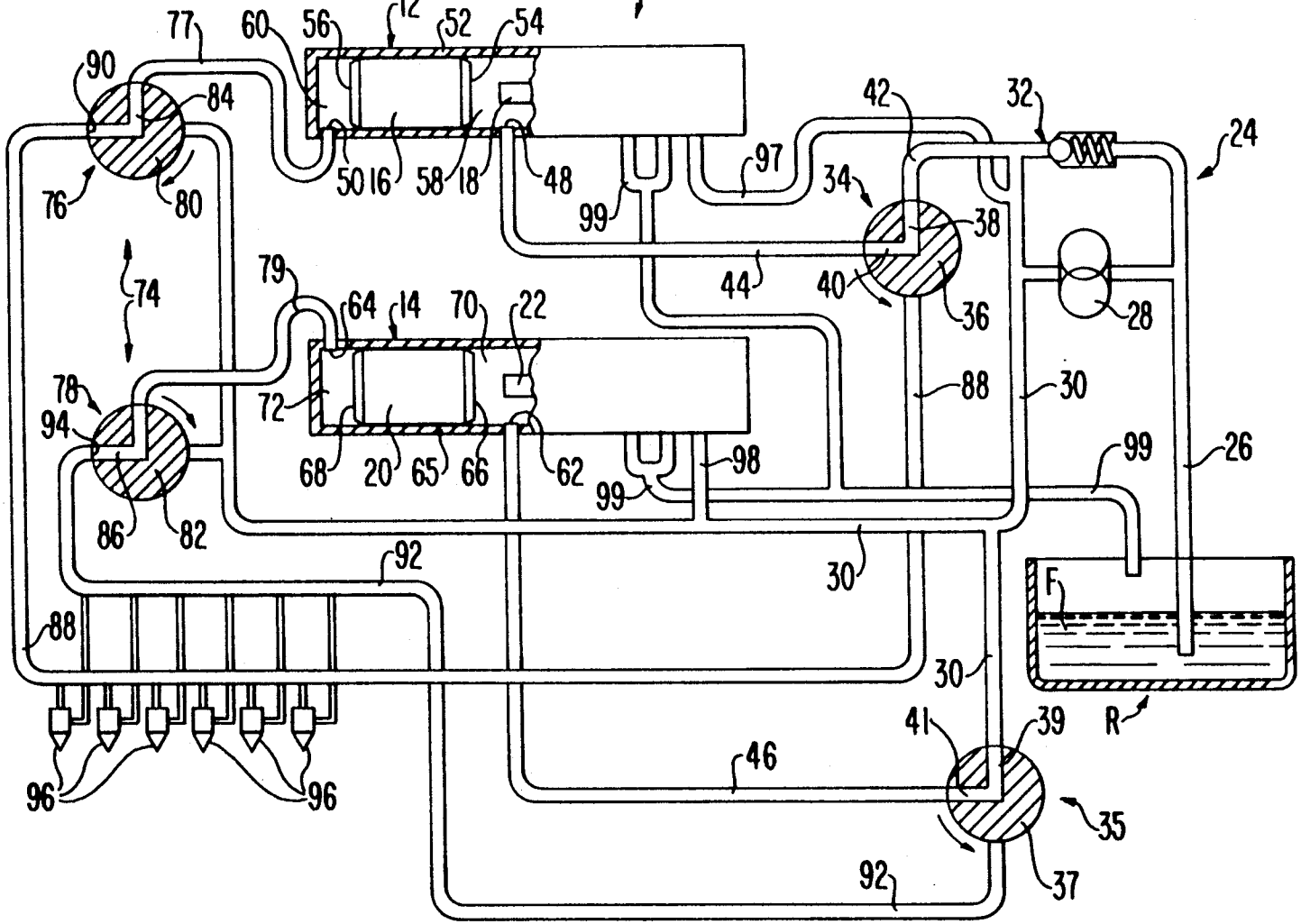
FIG. 1 is a schematic illustration of a fuel injection system incorporating a position-servo device formed in accordance with the present invention.

Referring now to the several figures and more particularly to FIG. 1, one application of the position-servo device of the present invention is shown. Within the system is provided a fuel pump 10 for use with an internal combustion engine having a fuel reservoir R and a plurality of engine cylinders containing reciprocating engine pistons (not illustrated). The fuel pump 10 includes a first positive displacement fuel slug forming means 12 and a second positive displacement timing slug forming means 14. The fuel slug forming means 12 includes a shuttle 16 and a stop element 18, and timing slug forming means 14 includes a shuttle 20 and a stop element 22. The stop elements 18 and 22 are adjustably controlled for varying the stroke length of shuttles 16 and 20 respectively by a position-servo device that is a subject of the present invention. The position-servo device is described in greater detail with reference to FIGS. 2–5 below, and is referenced at this point simply to operatively position the position-servo devices within a preferred fuel system application. At this point it is noted that a fuel system utilizing the subject position-servo device could be a fuel injection system that provides pre-metered slugs of injection and timing fuel such as noted above in the Background section and described in U.S. Pat. No. 4,621,605 to Carey, Jr. et al., owned by the assignee of the present invention and herein incorporated by reference. However, a preferred version of a fuel injection system to which the subject position-servo device is applicable is described below having a double-acting shuttle action.

Basically, the fuel injection system includes within the fuel pump 10 a fuel supply means 24 for withdrawing fuel F from the reservoir R. The fuel supply means 24 includes a supply pipe 26 connected to a delivery pump 28 that is further connected with a supply line 30. A pressure relief valve 32 is also provided for maintaining a set pressure within the fuel pump 10.

The fuel pump 10 further includes a first fuel flow control means 34 for controlling flow from the fuel supply means 24 to the remainder of the fuel pump 10. The fuel flow control means 34 has a movable valve body 36 with passages 38 and 40 therein. In the orientation of FIG. 1, the valve body 36 connects pressurized fuel from the delivery pump 28 through supply line 30 and a secondary line 42 to a further line 44. The further line 44 being connected to the fuel slug forming means 12.

The fuel slug forming means 12 is fluidically connected to the line 44 by a port at 48, and a port 50 is also provided to fluidically connect the fuel slug forming means 12 to a conduit 77 for reasons described below. The shuttle 16 is movably positioned within a housing 52 of the fuel slug forming means 12 and has a first end 54 in fluid communication with port 48, and a second end 56 in fluid communication with the port 50. The first end 54, together with housing 52, forms a fuel chamber 58, and the second end 56, together with housing 52, defines a second fuel chamber 60. Fuel received in chamber 58 from the fuel supply means 24 and the fuel control means 34 tends to move shuttle 16 toward port 50 in a fuel slug delivery process, and fuel received in chamber 60 tends to move shuttle 16 toward port 48 in a second fuel slug delivery process.

Due to the positive displacement nature of the fuel slug forming means 12, fuel is received and delivered by the fuel slug forming means 12 in discreet slugs of set volume. These discreet slugs of fuel are termed pre-metered fuel slugs and have volumes which are precisely and accurately metered and set by the travel of shuttle 16 of the fuel slug forming means 12.

In the preferred embodiment, the fuel pump 10 also includes a positive displacement timing fluid slug forming means 14 that operates in the same manner as the fuel slug forming means 12. The supply line 30 is further connected to a second flow control means 35 having a movable valve body 37 with passages 39 and 41 therein. In the FIG. 1 orientation, the valve body 37 connects the pressurized fuel from the delivery pump 28 through supply line 30 to a secondary line 46. The line 46 is further connected to the timing fluid slug forming means 14 at port 62, and the timing fluid slug forming means 14 also includes a second port at 64. A housing 65 is also provided within which the shuttle 20 is movably positioned. A first end of shuttle 20 is provided at 66 which defines with the housing 65 a timing fuel chamber 70, and a second end 68 of shuttle 20 with the housing 65 defines a timing fuel chamber at 72. The tendencies of the shuttle to move in each direction are the same as that described above with respect to shuttle 16.

The fuel pump 10 further includes a third fuel flow control means 74 which includes a first three-way control valve 76 fluidically connected to the port 50 of the fuel slug forming means 12 by conduit 77, and a second three-way flow control valve 78 fluidically connected to port 64 of the timing fluid slug forming means 14 by a conduit 79. Three-way flow control valves 76 and 78 include movable valve bodies 80 and 82 respectively. Valve bodies 80 and 82 include angled passages 84 and 86 respectively extending therethrough. In the FIG. 1 orientation of fuel pump 10, the angled passages 84 and 86 of the third fuel flow control means 74 are fluidically connected with conduits 77 and 79 to receive pre-metered slugs from the fuel slug forming means 12 and from the timing slug forming means 14, respectively, when the fuel pump 10 is in a slug delivery mode.

A fuel common rail 88 has an inlet 90 fluidically connected to the first three-way control valve 76 of the third fuel flow control means 74 to receive pre-metered slugs of fuel when the passage 84 in the valve body 80 is aligned with the common rail inlet 90 when the fuel pump 10 is in a first slug delivery configuration. A timing fluid common rail 92 has an inlet 94 fluidically connected to passage 86 of the three-way control valve 78 of the third fuel flow control means 74 to receive pre-metered slugs of timing fluid when the passage 86 of valve body 82 is aligned with common rail inlet 94 when fuel pump 10 is in a first slug delivery configuration.

The fuel common rail 88 is further connected to the first fuel flow control means 34 to be fluidically connected with line 44 in a second slug delivery configuration, as will be apparent in the description of the operation below. Likewise, timing fluid common rail 92 is connected to the second fuel flow control means 37 to be fluidically connected to line 46 in the second slug delivery configuration.

In operation, the double-acting shuttle action of each shuttle 16 and 20 takes place depending on the relative positions of valve bodies 36, 37, 80 and 82. In FIG. 1, the valve bodies 36, 37, 80 and 82 are oriented so as to define a first slug delivery configuration. In the first slug delivery configuration, pressurized fuel in the supply line 30 is connected to lines 44 and 46 by valve bodies 36 and 37 thus supplying the pressurized fuel to fluid chambers 58 and 70 of the fuel slug forming means 12 and the timing fluid slug forming means 14 respectively. The tendency of the shuttles 16 and 20 is to move toward the ports 50 and 64 thus driving pre-metered quantities of fuel already within chambers 60 and 72 into lines 77 and 79 through valve bodies 80 and 82 and thus to the fuel common rail 88 and the timing fluid common rail 92, respectively. Thus, it is apparent that all four valve bodies, 36, 37, 80 and 82, must be oriented as shown in FIG. 1 to complete a first slug delivery operation.

The valve bodies 36, 37, 80 and 82 are each operatively driven to rotate together at a 1:1 ratio in a conventional manner. Valve bodies 36 and 37 rotate in a counterclockwise direction, while the valve bodies 80 and 82 rotate in a clockwise direction. It is not necessary that the valve bodies move in the aforesaid directions, however, it is necessary that the sequence of line connections be completed in the proper order.

Thus, to obtain a second slug delivery configuration it is necessary for all four of the valve bodies to move one quarter turn from that shown in FIG. 1, wherein valve bodies 80 and 82 move a quarter turn clockwise while valve bodies 36 and 37 move a quarter turn counterclockwise. In the second slug delivery configuration, the fuel previously provided in chambers 58 and 70 of the fuel slug forming means 12 and timing fluid slug forming means 14, respectively, is connected with the fuel common rail 88 and the timing fluid common rail 92, respectively, by passing through line 44 and valve body 36 in one case and line 46 and valve body 37 in the other case. In the meantime, the pressurized fuel within line 30 is connected to lines 77 and 79 to introduce pressurized fuel into the chambers 60 and 72 of the fuel slug forming means 12 and the timing fluid slug forming means 14, respectively, by way of the valve bodies 80 and 82 that are turned clockwise by one quarter turn.

As a result, it is apparent that the pressurized fuel in line 30 from pump 28 is used to form pre-metered slugs of fuel within the chambers 58, 70, 60, and 72 as determined by the first or second slug delivery configurations described above. The pressurized fuel within chambers 60 and 72 causes delivery from chambers 58 and 70, while pressurized fuel connected to chambers 58 and 70 causes the delivery of pre-metered slugs of fuel from chambers 60 and 72. As the valve bodies 36, 37, 80 and 82 are rotated together it can be seen that a double-acting shuttle is provided that delivers fuel to the common rails 88 and 92 in two slug delivery configurations. It is further apparent that the adjustably positionable stop elements 18 and 22 set the size of the pre-metered slugs of fuel and timing fluid that are formed by defining the size of the chambers 58, 70, 60 and 72.

The fuel injection system also includes a plurality of unit injectors 96 associated with the corresponding number of engine cylinders of an internal combustion engine. The injectors 96 are fluidically connected to the common rails 88 and 92 to receive the pre-metered slugs of fuel and timing fluid from fuel pump 10. The specific operation of a unit injector is not described herein since it does not form an integral part of the present invention; however, it is understood that any known unit injector can be used such as that disclosed in the aforementioned U.S. Pat. No. 4,621,605. It is also understood that, the above system could be modified to only include fuel slug delivery means for the injectors if a unit injector is used that does not include the advantageous use of timing fluid.

As is evident from the above description of the fuel injector system, it is desirable that the stop elements 18 and 22 be adjustably provided within the fuel slug forming means 12 and timing slug forming means 14 so that precise changes in the volume of the pre-metered slugs can be made quickly and effectively. Preferably, adjustments are made on a cycle-by-cycle basis of the engine pursuant to constantly monitored engine operating characteristics, such as engine temperature and loading. In order to accomplish quick and accurate adjustment, the present invention includes a position-servo device 100 (not shown in FIG. 1) for adjustably locating one of the stop elements 18 or 22. In this regard, only one position-servo device 100 will be described below, with the understanding that such a position-servo device is equally applicable to any stop element that must be adjustably located in position. Furthermore, the position-servo device is operated by fuel pressure lines at 97 and 98 (shown in FIG. 1) that are connected to the supply line 30 for operation of the position-servo device, as will become apparent with the description below. Additionally, drain lines 99 are provided that run to the reservoir for operation for the reasons set forth below.

Figure 2:
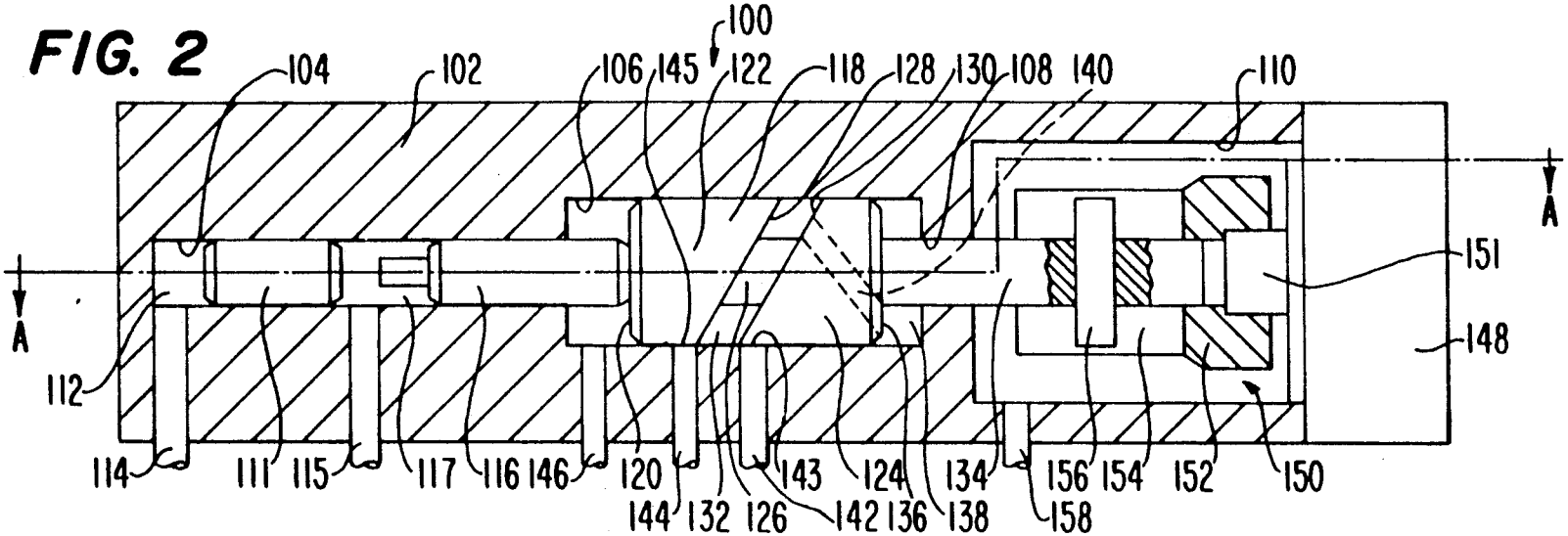
FIG. 2 is a partial cross-sectional view of the position-servo device of the present invention with a stop element and shuttle of a fuel injection system.
Figure 3:
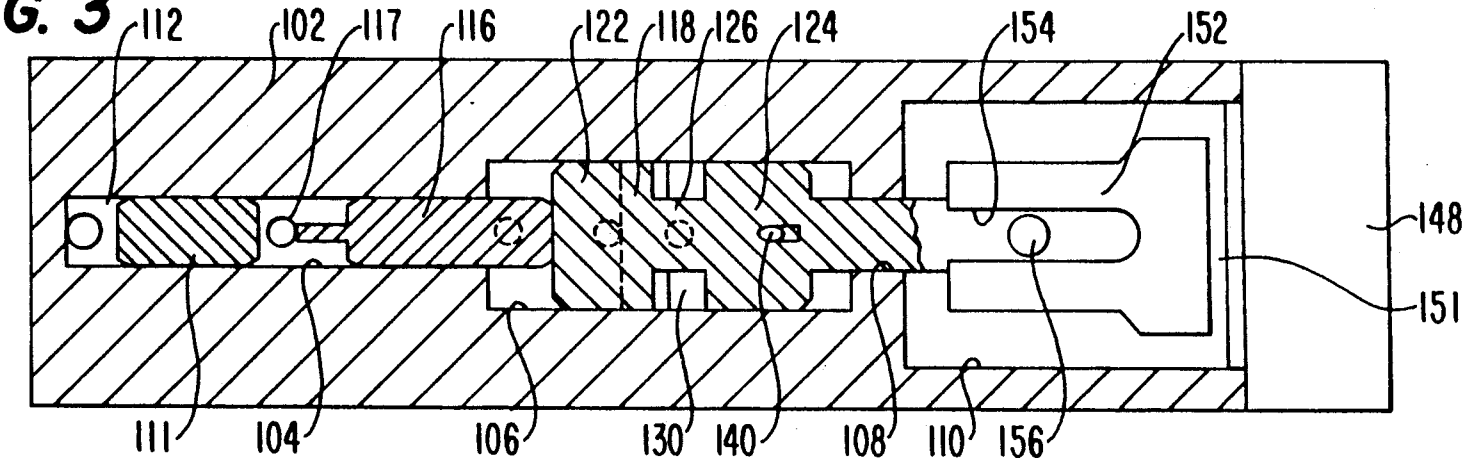
FIG. 3 is a cross-sectional view taken along line A—A of FIG. 2.

With reference now to FIGS. 2 and 3, the position-servo device 100 is described, wherein a housing 102 is provided with a series of collinear bores 104, 106, 108, and 110. To facilitate manufacturing, the housing 102 can be made as a split housing. The first bore 104 facilitates the sliding movement of a shuttle 111 (same as shuttle 16 or 20 in the fuel system of FIG. 1) of a positive displacement fuel injection system. Between the shuttle 111 and the end of the bore 104 is provided a slug forming and delivery chamber 112 operating like that described above. This slug forming and delivering chamber 112 is fluidically connected by way of a conduit 114 to the fuel slug delivery system. Also within the bore 104, a stop element 116 (same as stop element 18 or 22 in the fuel system of FIG. 1) is provided that is also slidably movable within the bore 104. This stop element functions to limit the stroke of travel of the shuttle 111 in the manner as described above, while the stop element 116 is adjustably movable and held in position as described below. Moreover, between the stop element 116 and the shuttle 111, a fuel chamber is formed at 117 which communicates through line 115 with the aforementioned fuel supply system.

The second bore 106 is of a larger diameter than the first bore 104 and partially receives the stop element 116 so that a control shaft 118 provided in bore 106 with a face at 120 can abut and move the stop element 116 to bring the stop element 116 to an adjusted location. The control shaft 118 includes two larger diameter sections 122 and 124 that are substantially sealingly engaged with the interior of the bore 106. Provided between the large diameter sections 122 and 124 is a small diameter section 126. The large diameter sections 122 and 124 include opposed helical surfaces 128 and 130 respectively that are parallel to one another. Helical as used above and hereinafter is used to mean that the surfaces are provided on a plane oblique to the axis of the control shaft 118, and not to define a true helix. The helical surfaces 128 and 130 together define with the small diameter section 126 an oblique ring-like chamber 132 between the large diameter sections 122 and 124. The control shaft 118 further includes a second small diameter section 134 extending out of the bore 106 through smaller bore 108 and into a larger bore 110.

Where the second smaller diameter portion 134 joins the large diameter section 124, a face 136 is formed which defines with the rightmost end of the bore 106, a pressure chamber 138. A passage 140 is also provided extending through the second larger portion 124 so as to permit fluid communication between the oblique ring-like chamber 132 and the pressure chamber 138. The second smaller diameter section 134 is sealingly provided within the bore 108, so as not to permit fluid flow from the pressure chamber 138 into the bore 110. It is understood that conventional seals could be utilized if desired.

The second bore 106 connects with a pressurized fluid source through line 142 (corresponding to line 97 or 98 of FIG. 1) and with a drain through lines 144 and 146 (corresponding with lines 99 in FIG. 1). The inlet 143 of pressure line 142 and the outlet 145 of drain line 144 are spaced axially along the bore 106 along the same line such the distance between the closest circumferential edges of inlet 143 and outlet 145 is at least equal to the distance between the parallel helical surfaces 128 and 130 on sections 122 and 124. The reason that at least this distance must be maintained will become more apparent with the description of the operation below. The second drain line 146 simply facilitates the easy sliding of the control shaft 118 within bore 106 and provides a drain for leakage fluid.

The second smaller diameter section 134 of the control shaft 118 extends into the bore 110 and is connected to a low torque stepping motor 148 by a connector means 150 that rotationally fixes the shaft portion 134 to the motor shaft 151 for rotational drive, but permits axial sliding between the shaft portion 134 and the motor shaft 151. In one preferred embodiment of the connector means 150, a sleeve 152 is fixed with the motor shaft 151, and the sleeve 152 includes diametrically opposed slots 154 into which a pin 156 fixed with shaft portion 134 is inserted. Thus, the pin 156 and the control shaft 118 can move axially with respect to the sleeve 152 and motor shaft 151, but, rotational drive is maintained. Also provided within the bore 110 is a drain line 158 that permits easier axial movement of the control shaft 118 as well as drainage of fluid leakage.

In operation of the position-servo device 100 of FIGS. 2 and 3, it is only necessary to rotate the control shaft 118 by way of the connector means 150 and stepping motor 148 thereby determining the amount that the control shaft 118 will subsequently move axially due to hydraulic action within the second bore 106. In FIG. 2, the stop element 116 is in its rightward most position due to the positioning of the helical surfaces 128 and 130 of portions 122 and 124. It is actually the external surfaces of the sections 122 and 124 that open or close the pressure line 142 and drain line 144 just adjacent the helical surfaces 128 and 130. Thus, any incremental rotation from the FIG. 2 position will result in the opening of the supply line 142 while maintaining the drain line 144 in a closed position. The pressurized fluid will flow into the oblique chamber 132 through the passage 140 leading to the pressure chamber 138. As a result, the control shaft 118 will be shifted toward the left in FIG. 2 until the supply line 142 is closed off. Thus, axial positioning is accomplished simply by rotating the control shaft 118 As the control shaft 118 is axially moved, so is the stop element 116.

Once the control shaft 118 has been moved leftward from the FIG. 2 position, it is then possible to move the control shaft back to the right (additional leftward movement is also a possibility) by rotating the control shaft in the direction that will open the drain line 144 so that fluid is released from oblique chamber 132 while the fuel supply is maintained closed. The rightward movement will occur until the drain line is once again blocked, at which time a hydraulic lock will occur within chambers 138 and 132. The amount of movement is determined by the extent of rotation of the control shaft 118 and the pitch of the helical surfaces 128 and 130. This rightward movement is further facilitated by the fluid pressure within the fuel receiving chamber 117 acting on the stop element 116

It is important to note that for the leftward movement to take place, it is necessary that the surface area of the face 136 on section 124 of control shaft 118 be larger than the surface area of the stop element 116 at the fuel receiving chamber 117 or that the pressure in pressure chamber 138 be greater than in chamber 117. Since the present system contemplates using the same fuel source for both the hydraulic fluid within pressure chamber 138 and the fuel receiving chamber 117, the increased surface area of face 136 is sufficient to insure such movement. Thus, with a same pressurized fuel source, a proper movement is guaranteed.

Figure 4:
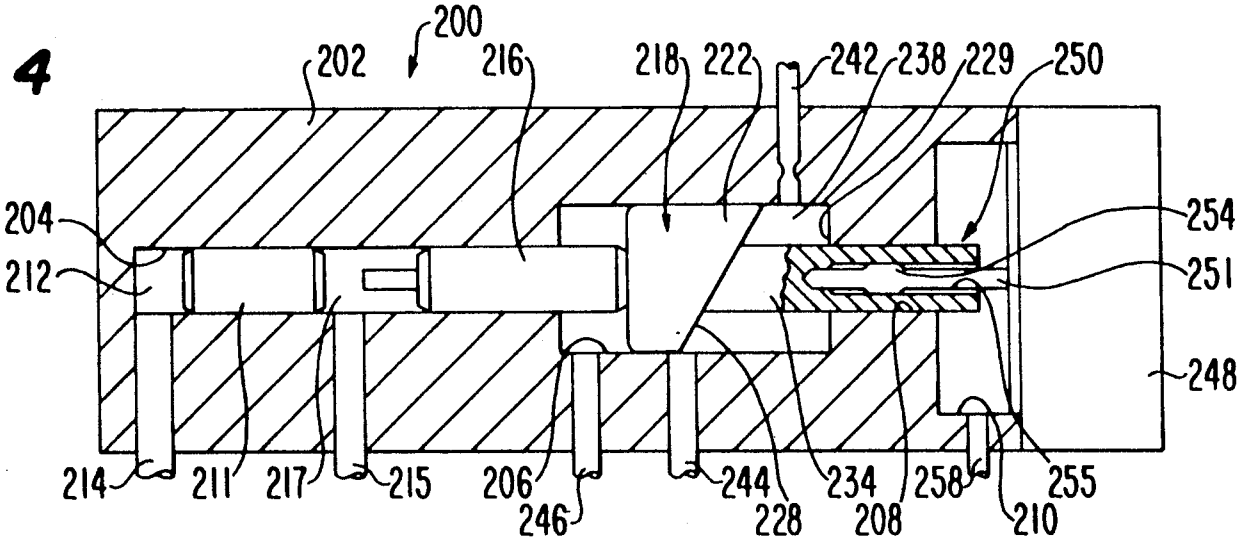
FIG. 4 is a partial cross-sectional view of another embodiment of a position-servo device in accordance with the present invention also showing a stop element and shuttle of a fuel injection system.

With reference now to FIG. 4, a second embodiment is described as follows. A position-servo device 200 is provided including a housing 202 having a first bore 204, a second bore 206, a third bore 208, and a fourth bore 210. Likewise as in the FIG. 2 embodiment, a shuttle 211 and stop element 216 are provided within first bore 204. Slug forming and delivering chambers 212 and 217 are provided at opposite sides of the shuttle 211. Accordingly, chamber 212 is connected to a conduit 214 and chamber 217 is connected to a conduit 215. A control shaft 218 is slidingly and substantially sealingly located within the second bore 206, and the bore 206 is connected to a fluid pressure line 242 and drain lines 244 and 246. The control shaft 218; however, includes only a single larger diameter portion 222 with a single helical surface 228. Extending from the helical face 228 is a smaller diameter portion 234 that sealingly extends through third bore 208 into the fourth bore 210. The smaller diameter portion 234 is also connected to a low torque stepping motor by a connection means 250 that rotationally drives shaft 218 by motor shaft 251 but permits axial sliding therebetween. In this embodiment, the motor shaft 251 includes external splines 254 that engage in internal splines 255 within a bore in shaft portion 234.

Once again, the FIG. 4 embodiment of the position-servo device 200 requires only that the control shaft 218 be rotationally moved by any increment, whereby axial movement will result therefrom. The degree of axial movement is determined by the degree of rotation of control shaft 218 as well as the pitch of helical surface 228. Specifically, fuel is constantly supplied by supply line 242 into a pressure chamber 238 formed between the helical surface 228 and a side wall 229 of the bore 206. The fluid fills the pressure chamber 238 until it is shifted axially leftward to a point where drain 244 is opened. When the drain 244 is opened, the leftward movement of the control shaft 218 is stopped. This stopping is aided by fuel pressure within the chamber 217 acting on the stop element 216. Then, in order to shift the stop element 216 and control shaft 218 in either direction, it is simply necessary to rotate the control shaft 218 thus changing the position of portion 222 with respect to its external circumferential surface and the drain line 244. The result is that the rotational movement will either close or increase the opening of the drain line 244 after which the control shaft 218 will obtain an equilibrium position moving the control shaft 218 to the right or left. Drains 246 and 258 are used for leakage and pressure equalization.

Figure 5:
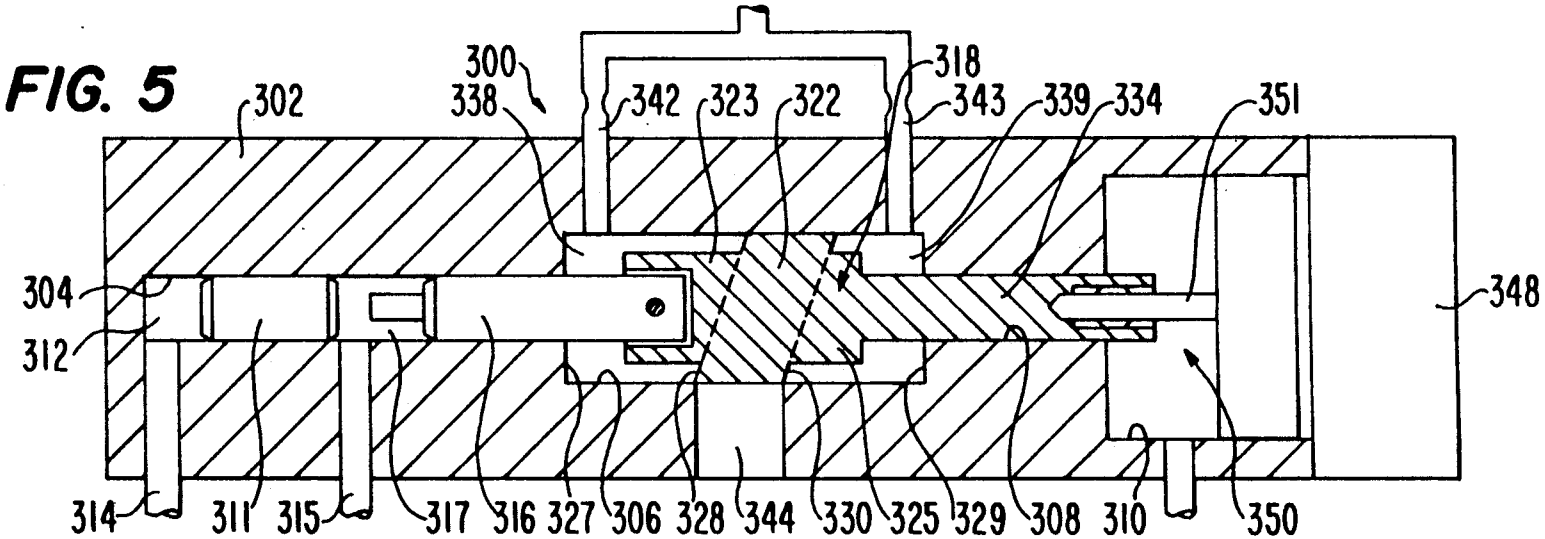
FIG. 5 illustrates yet another embodiment of the present invention partially in cross-section with a stop element and shuttle of a fuel injection system.

In FIG. 5, yet another embodiment of a position-servo device 300 is disclosed. The position-servo device 300 includes a housing 302 provided with a first bore 304, a second bore 306, a third bore 308, and a fourth bore 310. A shuttle 311 is provided within the first bore 304 as well as is a portion of the stop element 316. Slug forming and delivering chambers 312 and 317 are defined on opposite sides of the shuttle 311. Appropriately, lines 314 and 315 are connected to the chambers 312 and 317 respectively. Once again, within the bore 306, a control shaft 318 is located including a smaller diameter portion 334 that sealingly extends through third bore 308 into fourth bore 310. The smaller diameter section 334 is connected to a low torque stepping motor 348 by way of a connector means 350 permitting axial sliding but maintaining rotational drive throughout the length of axial sliding. As in FIG. 4, this is accomplished by a spline mechanism.

The second bore 306 communicates with two pressure lines 342 and 343 from a single source, and also includes a drain opening 344. In this case, the control shaft 318 includes a large diameter section 322 provided on both sides with medium diameter sections 323 and 325. The large diameter section 322 is defined on both sides by parallel helical surfaces 328 and 330 that extend between the large diameter portion 322 and both medium diameter portions 323 and 325. It is also shown in the FIG. 5 embodiment, that the stop element 316 can be connected with the control shaft 318 by a pin or other conventional means to move therewith.

In operation of the FIG. 5 embodiment, pressurized fluid enters pressure chambers 338 and 339 defined on both sides of the large diameter section 322 and the end walls 327 and 329 of the bore 306. The axial length of the large diameter portion 322 is substantially equal to or slightly larger than the axial length of the drain opening 344 so that the control shaft 318 is maintained in equilibrium with the large diameter portion 322 closing the drain opening 344. Subsequently, movement of the stop element 316 and control shaft 318 in either direction can be accomplished by simply rotating the control shaft 318. Once the control shaft 318 is rotated, the pressurized fluid from lines 342 and 343 will cause the control shaft 318 to once again find its equilibrium position. This position being when the drain opening 344 is completely blocked by the large diameter portion 322. Thus, by rotating the control shaft 318 by any increment, one side of drain opening 344 will be opened and the control shaft 318 will move to block the opening. Accurate positioning of the control shaft 318 and stop element 316 is thereby provided.

Thus, it will be noted that an improved positioning device is provided wherein a stop element can be quickly and precisely realigned with a minimum of moving parts and minimal effort. Moreover, the ability to use the same pressurized fuel as is delivered to the positive displacement fuel pump facilitates the easy modification of existing fuel pumps with the position-servo device of the present invention as well as in production fuel systems. Furthermore, engine operating characteristics can be monitored to control the adjustment of the stop element to modify the fuel quantity provided to the injectors.

INDUSTRIAL APPLICABILITY

While the position-servo device disclosed herein is most useful for positioning a stop element within a positive displacement type fuel injection system, it is important to note that such a position-servo utilizing a constant fluid pressure source can be used for positioning any element in a manner in which precise and quick alignment and realignment is necessary. The device is particularly useful where hydraulic pressure is utilized for another part of the system so that the same pressurized hydraulic fluid can double as the operative fluid for the position-servo device. However, separate fluid sources are also contemplated provided that it is kept in mind that the control shaft must be able to move in either direction. This movement being a function of the surface area of the face of the control shaft in its pressure chamber as opposed to the pressure applied to the opposite end of the control shaft.

We claim:

1. A position-servo device comprising:

a housing having at least one bore with an end wall at an end of said bore and an opening through said end wall collinear to said bore, said housing including at least one fluid pressure supply line and one drain line in communication with said bore;

a control shaft including a large diameter portion rotationally and axially slidably disposed within said bore and sealingly engaged with an interior surface of said bore, a small diameter portion extending through said opening in said end wall and sealingly engaged to said opening, and an oblique surface provided on said large diameter portion, wherein said large diameter portion, said end wall and said bore define a pressure chamber and said oblique surface is fluidically in communication with said pressure chamber;

a rotational drive means operatively connected to said small diameter portion of said control shaft by means providing for rotational drive transfer from said drive means to said control shaft, while permitting axial movement therebetween;

pressurization means connected to said fluid supply line and said drain line for causing the axial position of said control shaft to be determined by the orientation of said oblique surface with respect to said fluid supply line and said drain line, so that rotation of said control shaft changes the orientation of said oblique surface which changes the axial position of said control shaft, wherein said control shaft includes a stopping surface which is positioned axially by said control shaft; and a shuttle element mounted for axial movement within said housing along a path one end of which is defined by the position of said stopping surface.

2. The device of claim 1, wherein said control shaft includes two large diameter portions connected together by a second small diameter portion, the large diameter portions having opposed oblique surfaces parallel to one another, thereby defining with said second small diameter portion and said bore, an oblique ring-like chamber, and one of said large diameter portions includes a passage therethrough permitting fluid communication between said pressure chamber and both oblique surfaces.

3. The device of claim 2, wherein said fluid pressure supply line and said drain line are axially spaced within said bore on a common line by a distance between closest edges of the lines at least equal to the distance between the opposed parallel oblique surfaces of said control shaft.

4. The device of claim 3, wherein said stopping surface is formed on a stop element operatively associated with said control shaft to move axially with said control shaft.

5. The device of claim 4, wherein said stop element is provided within a second bore of said housing to sealingly slide therein, and said shuttle element is also slidably and sealingly disposed within said second bore, whereby said stop element determines the stroke distance of travel of said shuttle element.

6. A position-servo device for adjustably positioning a stop element comprising:

a housing having at least one bore with an end wall at an end of said bore and an opening through said end wall collinear to said bore, said housing including at least one fluid pressure supply line and one drain line in communication with said bore;

a control shaft including a large diameter portion rotationally and axially slidably disposed within said bore and sealingly engaged with an interior surface of said bore, a small diameter portion extending through said opening in said end wall and sealingly engaged to said opening, and an oblique surface provided on said large diameter portion, wherein said large diameter portion, said end wall and said bore define a pressure chamber and said oblique surface is fluidically in communication with said pressure chamber;

a rotational drive means operatively connected to said small diameter portion of said control shaft by means providing for rotational drive transfer from said drive means to said control shaft, while permitting axial movement therebetween; and pressurization means connected to said fluid supply line and said drain line for causing the axial position of said control shaft to be determined by the orientation of said oblique surface with respect to said fluid supply line and said drain line, so that rotation of said control shaft changes the orientation of said oblique surface which changes the axial position of said control shaft, wherein said drain line and said fluid pressure supply line are axially spaced apart in said bore by a distance greater than an axial component of the slope of said oblique surface, wherein said pressure chamber is defined by said bore, said small diameter section, said end wall and said oblique surface.

7. The device of claim 5, further including a stop element operatively associated with said control shaft to move axially with said control shaft.

8. The device of claim 7, wherein said stop element is provided within a second bore of said housing to sealingly slide therein, and a shuttle of a positive displacement fuel pump is also slidably and sealingly disposed within said second bore, whereby said stop element determines the stroke distance of travel of said shuttle.

9. A position-servo device for adjustably positioning a stop element comprising:

a housing having at least one bore with an end wall at an end of said bore and an opening through said end wall collinear to said bore, said housing including at least one fluid pressure supply line and one drain line in communication with said bore;

a control shaft including a large diameter portion rotationally and axially slidably disposed within said bore and sealingly engaged with an interior surface of said bore, a small diameter portion extending through said opening in said end wall and sealingly engaged to said opening, and an oblique surface provided on said large diameter portion, wherein said large diameter portion, said end wall and said bore define a pressure chamber and said oblique surface is fluidically in communication with said pressure chamber;

a rotational drive means operatively connected to said small diameter portion of said control shaft by means providing for rotational drive transfer from said drive means to said control shaft, while permitting axial movement therebetween; and pressurization means connected to said fluid supply line and said drain line for causing the axial position of said control shaft to be determined by the orientation of said oblique surface with respect to said fluid supply line and said drain line, so that rotation of said control shaft changes the orientation of said oblique surface which changes the axial position of said control shaft, wherein said control shaft includes two parallel oblique surfaces at each axial side of said large diameter portion, so that two pressure chambers are defined within said bore on each side of said large diameter portion, one pressure chamber defined by one oblique surface, said smaller diameter portion, said bore, and said end wall, the other pressure chamber defined by the other oblique surface, said bore, and a second end wall, at least one fluid pressure supply line communicates with such pressure chamber, and said drain line is an opening having an axial length no more than equal to the distance between said parallel oblique surfaces, wherein said control shaft includes a stopping surface which is positioned axially by said control shaft; and a shuttle element mounted for axial movement within said housing along a path one end of which is defined by the position of said stopping surface.

10. The device of claim 9, wherein said stopping surface is formed on a stop element operatively associated with said control shaft to move axially with said control shaft.

11. The device of claim 10, wherein staid stop element is provided within a second bore of said housing to sealingly slide therein, and said shuttle element is also slidably and sealingly disposed within said second bore, whereby said stop element determines the stroke distance of travel of said shuttle element.

12. An adjustable stop device for use in a positive displacement fuel injection system having a shuttle element for forming and delivering metered slugs of fuel, wherein a stroke distance of the shuttle is determined by said adjustable stop device, comprising:

a housing having a first bore for slidably receiving the shuttle element of the positive displacement fuel injection system, said housing also having a second bore collinear to said first bore, with a diameter greater than said first bore with an end wall at an end of the said second bore and an opening through said end wall collinear to said second bore, said housing including at least one fluid pressure supply line and one drain line in communication with said second bore;

a control shaft including a large diameter portion rotationally and axially slidably disposed within said second bore and sealingly engaged with an interior surface of said second bore, a small diameter portion extending through said opening in said end wall and sealingly engaged to said opening, and an oblique surface provided on said large diameter portion, wherein said large diameter portion, said end wall and said second bore define a pressure chamber and said oblique surface is fluidically in communication with said pressure chamber;

a rotational drive means operatively connected to said small diameter portion of said control shaft by means providing for rotational drive transfer from said drive means to said control shaft, while permitting axial movement therebetween;

pressurization means connected to said fluid supply line and said drain line for causing the axial position of said control shaft to be determined by the orientation of said oblique surface with respect to said fluid supply line and said drain line, so that rotation of said control shaft changes the orientation of said oblique surface which changes the axial position of said control shaft, wherein said control shaft includes a stopping surface which is positioned axially by said control shaft; and wherein said housing mounts the shuttle element for axial movement along a path one end of which is defined by the position of said stopping surface.

13. The device of claim 12, wherein said control shaft includes two large diameter portions connected together by a second small diameter portion, the large diameter portions having opposed oblique surfaces parallel to one another, thereby defining with said second small diameter portion and said second bore, an oblique ring-like chamber, and one of said large diameter portions includes a passage therethrough permitting fluid communication between said pressure chamber and both oblique surfaces.

14. The device of claim 13, wherein said fluid pressure supply line and said drain line are axially spaced within said second bore on a common line by a distance between closest edges of the lines at least equal to the distance between the opposed parallel oblique surfaces of said control shaft.

15. The device of claim 12, wherein said drain line and said fluid pressure supply line are axially spaced apart in said second bore by a distance greater than an axial component of the slope of said oblique surface, wherein said pressure chamber is defined by said second bore, said small diameter section, said end wall and said oblique surface.

16. The device of claim 12, wherein said control shaft includes two parallel oblique surfaces at each axial side of said large diameter portion, so that two pressure chambers are defined within said second bore on each side of said large diameter portion, one pressure chamber defined by one oblique surface, said smaller diameter portion, said second bore; and said end wall, the other pressure chamber defined by the other oblique surface, said second bore, and a second end wall, at least one fluid pressure supply line communicates with each pressure chamber, and said drain line is an opening having an axial length no more than equal to the distance between said parallel oblique surfaces.

17. A position-servo device comprising:

a housing having at least one bore with an end wall at an end of said bore and an opening through said end wall collinear to said bore, said housing including at least one fluid pressure supply line and one drain line in communication with said bore;

a control shaft including a large diameter portion rotationally and axially slidably disposed within said bore and sealingly engaged with an interior surface of said bore, a small diameter portion extending through said opening in said end wall and sealingly engaged to said opening, and an oblique surface provided on said large diameter portion, wherein said large diameter portion, said end wall and said bore define a pressure chamber and said oblique surface is fluidically in communication with said pressure chamber;

a rotational drive means operatively connected to said small diameter portion of said control shaft by means providing for rotational drive transfer from said drive means to said control shaft, while permitting axial movement therebetween;

pressurization means connected to said fluid supply line and said drain line for causing the axial position of said control shaft to be determined by the orientation of said oblique surface with respect to said fluid supply line and said drain line, so that rotation of said control shaft changes the orientation of said oblique surface which changes the axial position of said control shaft; and a fluid slug forming means operatively associated with said control shaft for delivering fluid slugs to a fluid system, said fluid slugs having a volume dependent on the rotational position of said control shaft, said fluid slug forming means including a stopping means for being positioned axially by said control shaft and a fluid shuttle means for intermittently contacting said stopping means.

* * * * *